United States Patent [19]

Maa et al.

[11] 4,322,283

[45] Mar. 30, 1982

[54] COAL CONVERSION IN THE PRESENCE OF ADDED HYDROGEN SULFIDE

[75] Inventors: Peter S. Maa, Baytown; Lavanga R. Veluswamy, Houston, both of Tex.

[73] Assignee: Exxon Research & Engineering Co., Florham Park, N.J.

[21] Appl. No.: 183,862

[22] Filed: Sep. 4, 1980

[51] Int. Cl.[3] ..... C10G 1/06

[52] U.S. Cl. ..... 208/8 R; 208/8 LE

[58] Field of Search ..... 208/8 R

[56] References Cited

U.S. PATENT DOCUMENTS

| | | | |
|---|---|---|---|
| 3,030,297 | 4/1962 | Schroeder . | |
| 3,375,175 | 3/1968 | Eddinger et al. . | |
| 3,503,863 | 3/1970 | Gatsis . | |
| 3,640,816 | 2/1972 | Bull et al. | 208/10 |
| 4,051,016 | 9/1977 | Metrailer et al. | 208/8 R |
| 4,094,765 | 6/1978 | Bearden, Jr. et al. | 208/8 LE |
| 4,115,075 | 9/1978 | McNamee | 208/8 LE |
| 4,235,699 | 11/1980 | Ratcliffe et al. | 208/8 R |

FOREIGN PATENT DOCUMENTS 2020691 11/1979 United Kingdom .

OTHER PUBLICATIONS

"Hydrogenation of Coal in the Batch Autoclave" Hawk et al., Bulletin 622, Bureau of Mines, 1965.

"Staged Temperature Coal Conversion Process" Lavanga R. Veluswamy et al., U.S. Ser. No. 180,543.

*Primary Examiner*—Delbert E. Gantz

*Assistant Examiner*—Olik Chaudhuri

*Attorney, Agent, or Firm*—Yale S. Finkle

[57] ABSTRACT

Coal or similar liquefiable carbonaceous solids are converted into lower molecular weight liquids by contacting the feed solids with molecular hydrogen in the absence of externally added hydrocarbon liquids and in the presence of added hydrogen sulfide under liquefaction conditions in one or more liquefaction zones.

24 Claims, 1 Drawing Figure

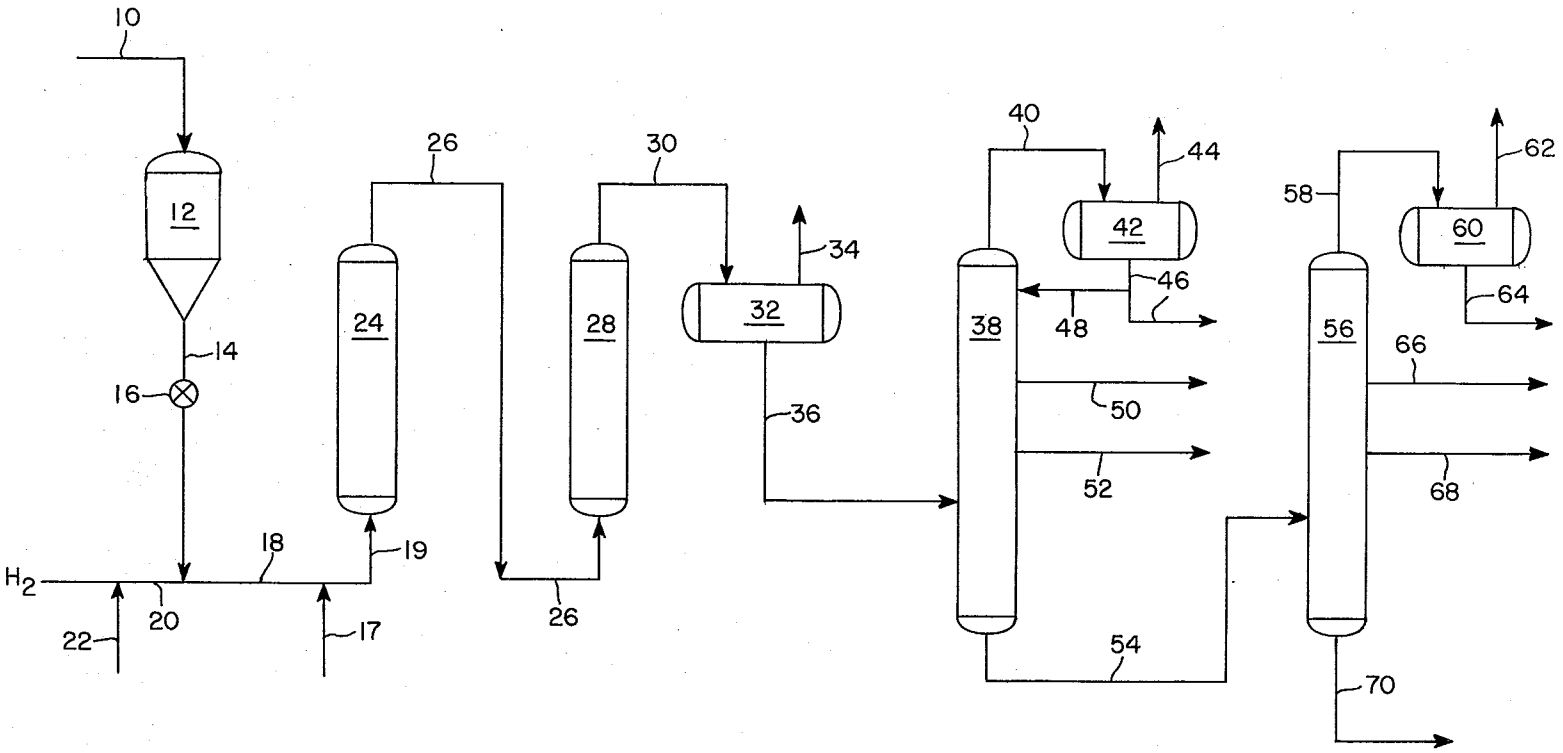
10
12
14
16
18
19
17
20
22
$H_2$
24
26
28
30
32
34
36
38
40
42
44
46
48
50
52
54
56
58
60
62
64
66
68
70

COAL CONVERSION IN THE PRESENCE OF ADDED HYDROGEN SULFIDE

BACKGROUND OF THE INVENTION

This invention relates to the conversion of coal and similar carbonaceous solids into liquids and is particularly concerned with a coal conversion process carried out in the absence of an externally added hydrocarbon solvent.

Processes for the conversion of coal and similar carbonaceous solids into hydrocarbon liquids normally require contacting of the solid feed material with a hydrocarbon solvent and molecular hydrogen at elevated temperature and pressure to break down the complex high molecular weight starting material into lower molecular weight hydrocarbon liquids and gases. The most promising processes of this type are those carried out with a hydrogen-donor solvent which gives up hydrogen atoms for reaction with organic radicals liberated from the coal or other feed material during the conversion or liquefaction step. In such a process, a portion of the liquids produced in the liquefaction reactor is recovered and catalytically hydrogenated in a solvent hydrogenation reactor to generate the hydrogen-donor solvent required in the liquefaction step. The heavy liquefaction product, which normally boils in excess of about 1000° F., recovered from the liquefaction reactor may be upgraded by subjecting it to pyrolysis to produce gases, additional hydrocarbon liquids, and coke which is subsequently steam gasified to form hydrogen and carbon monoxide for use as fuel.

Although hydrogen-donor liquefaction has numerous advantages over other liquefaction processes and produces a relatively large amount of liquids, it does require the use of a donor solvent produced by hydrogenating a portion of the liquid product in an external catalytic hydrogenation reactor. The production of this hydrogen-donor recycle solvent stream via catalytic hydrogenation external to the liquefaction step adds appreciably to the cost of the process and it would therefore be economically attractive if the recycle stream could be eliminated without decreasing the liquid yield from the process.

SUMMARY OF THE INVENTION

The present invention provides an improved process for converting coal or similar liquefiable carbonaceous solids into lower molecular weight liquid hydrocarbons which at least in part alleviates the difficulties referred to above. In accordance with the invention, it has now been found that high yields of liquid products can be obtained from bituminous coal, subbituminous coal, lignite, or similar solid carbonaceous feed materials without the use of an added hydrocarbon solvent or other liquid diluent by contacting the feed solids with molecular hydrogen in a liquefaction zone under liquefaction conditions in the absence of externally added hydrocarbon liquids and in the presence of added hydrogen sulfide. The residence time of the feed solids in the liquefaction zone will normally range between about 20 and about 200 minutes, preferably between about 40 and about 100 minutes. Normally, the liquefaction zone is operated at a temperature between about 750° F. and about 900° F., preferably between about 790° F. and about 860° F. The pressure in the liquefaction zone will normally range between about 300 psig and about 5000 psig, preferably between about 1500 psig and about 2500 psig. A sufficient amount of hydrogen sulfide gas or hydrogen sulfide-containing gas is normally added to the liquefaction zone to provide between about 1 and about 30 percent by volume of hydrogen sulfide based on the amount of hydrogen present. Preferably, the amount of hydrogen sulfide added will range from about 3 to about 10 volume percent.

In the preferred embodiment of the invention, the carbonaceous feed solids are contacted with molecular hydrogen under liquefaction conditions in the absence of externally added hydrocarbon liquids and in the presence of added hydrogen sulfide during sequential residence in two or more liquefaction zones arranged in series and operated such that the temperature in each zone increases from the first to the final zone of the series and the total of the residence times in all except the final zone of the series is sufficient to produce an increase in liquid yield over that obtainable by single stage liquefaction carried out under the conditions in the final zone. The effluent from each liquefaction zone excluding the final zone is passed to the next succeeding zone of higher temperature. In this manner the feed solids that are not liquefied or converted into lower molecular weight liquids in the initial zone are at least partially liquefied in the second zone, the unconverted solids in the effluent from the second zone are at least partially liquefied in the third zone, and so forth until the final zone is reached. Here the remaining unconverted solids are subjected to a relatively high temperature, preferably greater than about 790° F., for maximum conversion of solids into lower molecular weight liquids. The effluent from the last liquefaction zone is then treated to recover liquid hydrocarbonaceous products. Normally, no hydrocarbon liquids are added with the feed solids to the first liquefaction zone in the series and the only liquids introduced into each subsequent zone in the series are the liquids in the effluent from the preceding liquefaction zone. In general, the total of the residence times in all except the final liquefaction zone is above about 40 minutes, preferably between about 60 and about 200 minutes. The residence time in the final zone of the series will normally be between about 20 minutes and about 120 minutes, preferably between about 40 and about 90 minutes. The temperature in the initial zone will normally be at least 650° F., preferably between about 680° F. and about 750° F. The temperature in the final zone will normally range between about 790° F. and about 900° F., preferably between about 820° F. and about 860° F.

In the multizone embodiment of the invention, as many liquefaction zones as are economically viable may be utilized. In the most preferred embodiment of the invention, however, only two zones are used. The carbonaceous feed solids are contacted with molecular hydrogen in the absence of externally added hydrocarbon liquids and in the presence of added hydrogen sulfide under liquefaction conditions in the first liquefaction zone and the effluent from the first zone is subsequently subjected to liquefaction conditions in the presence of molecular hydrogen and hydrogen sulfide in the second liquefaction zone, which is maintained at a temperature greater than the temperature in the first liquefaction zone. Normally, the only liquids added to the second liquefaction zone are the liquids produced in the first liquefaction zone. Unconverted high molecular weight constituents from the first liquefaction zone are further converted into lower molecular weight liquids in the second liquefaction zone. A liquid hydrocarbonaceous product is recovered from the effluent of the second zone. Preferably, the temperature in the second zone is between about 80° F. and 150° F. greater than the temperature in the first zone. The residence time utilized in the first liquefaction zone will normally be greater, preferably between about 20 minutes and about 100 minutes greater, than the residence time in the second zone.

The process of the invention results in an increase in the amount of lower molecular weight hydrocarbon liquids produced from various types of coal by single stage liquefaction in the absence of an added hydrocarbon solvent. Furthermore, the process of the invention substantially increases the amount of liquids produced by staged temperature liquefaction of coals in the absence of an added hydrocarbon solvent and results in liquid yields comparable to those obtained by single stage liquefaction carried out in the presence of an added hydrogen-donor solvent. Thus, the preferred embodiment of the process of the invention provides a method of dispensing with the need for a hydrogenated hydrocarbon solvent without significantly decreasing the amount of liquid product produced.

BRIEF DESCRIPTION OF THE DRAWING

The drawing is a schematic diagram of a staged temperature coal conversion process for producing liquid products from coal carried out in accordance with the invention.

DESCRIPTION OF THE PREFERRED EMBODIMENTS

In the process depicted in the drawing, the solid carbonaceous feed material is introduced into the system through line 10 from a preparation plant, not shown, in which the coal or other material may be crushed, dried, and screened or from a storage facility which does not appear in the drawing. To facilitate handling of the solid feed material in the process, the coal or other carbonaceous solid is introduced into the system in a finely divided state, normally less than about 8 mesh on the U.S. Sieve Series Scale. The feed material employed in the process will normally consist of solid particles of bituminous coal, subbituminous coal, lignite, brown coal, or a mixture of two or more such materials. In lieu of coal other carbonaceous solids may be employed. Such materials include oil shale, coke, coal char, organic waste materials, liquefaction bottoms, and the like.

The carbonaceous solids introduced through line 10 are fed into closed hopper or similar vessel 12 from which they are discharged through a star wheel feeder or equivalent device 16 in line 14 at an elevated pressure sufficient to permit their entrainment into a stream of high pressure hydrogen or hydrogen-containing gas introduced into line 18 via line 20. The majority of the hydrogen in line 20 is recovered in downstream steps of the process, not depicted in the drawing, and recycled to line 20 through line 22. The mixture of hydrogen and entrained solids will normally contain from about 3 to about 50 weight percent, preferably from about 5 to about 20 weight percent, of hydrogen on a moisture and ash-free solids basis. Hydrogen sulfide or a hydrogen sulfide-containing gas is added to the hydrogen and solids in line 18 via line 17 and the resultant mixture is passed through line 19 into the bottom of first stage liquefaction reactor 24. Sufficient hydrogen sulfide is injected into line 18 to provide between about 1 and about 30 volume percent, preferably between about 3 and about 10 volume percent, of hydrogen sulfide based on the amount of hydrogen gas present in the mixture. A large portion of the hydrogen sulfide injected into line 18 through line 17 will be recovered in downstream steps of the process, not depicted in the drawing. Normally, no liquid phase or vapor phase hydrocarbon solvent is added to the liquefaction reactor with the entrained solids. Furthermore, no liquid hydrocarbons are normally introduced into the reactor from any external location. In lieu of or in addition to hopper 12 and star wheel feeder 16, the feed system may employ parallel lock hoppers, pressurized hoppers, aerated standpipes operated in series, or other apparatus to raise the input feed solid stream to the required pressure level.

The carbonaceous solids entrained in hydrogen and hydrogen sulfide are subjected to temperatures between about 680° F. and about 750° F., preferably between about 690° F. and about 720° F., as they pass upwardly with the hydrogen and hydrogen sulfide gases through liquefaction reactor 24. The pressure in the reactor is maintained between about 300 psig and about 5000 psig, preferably between about 1500 psig and about 2500 psig. The residence time of the solids which pass through the first stage reactor 24 will normally be above about 40 minutes and will preferably range from about 60 minutes to about 200 minutes. A residence time between about 120 minutes and about 170 minutes appears to be most preferable.

Within liquefaction reactor 24, the feed solids undergo liquefaction or chemical conversion into lower molecular weight constituents. The high molecular weight constituents of the carbonaceous feed solids are broken down and hydrogenated to form lower molecular weight gases and liquids. The hydrogen injected with the feed particles gives up hydrogen atoms that react with organic radicals liberated from the particles to stabilize them and thereby prevent their recombination. Evidently, the hydrogen sulfide facilitates the transfer of hydrogen from the gas phase to the liberated organic radicals. It is theorized that the hydrogen sulfide gives up hydrogen free radicals to the organic radicals thereby stabilizing them and also forming hydrogen sulfide free radicals (HS.) which, in turn, react with hydrogen molecules in the gas phase to reform hydrogen sulfide and produce additional hydrogen free radicals. Normally, between about 0.5 and about 4 weight percent hydrogen based on moisture and ash-free feed solids will be consumed during the passage of the solids through the liquefaction reactor. A small amount of hydrogen sulfide is also consumed in the reactor, apparently when hydrogen sulfide free radicals react with organic radicals.

The effluent from first stage liquefaction reactor 24, which contains gaseous liquefaction products such as carbon monoxide, carbon dioxide, ammonia, hydrogen, hydrogen sulfide, methane, ethane, ethylene, propane, propylene and the like, unreacted hydrogen and hydrogen sulfide from the feed mixture, light liquids, heavier liquefaction products including mineral matter, unconverted feed solids and high molecular weight liquids is withdrawn from the top of the reactor through line 26, preheated and passed to second stage liquefaction reactor 28. Normally, all of the liquids, unconverted carbonaceous solids and mineral matter from reactor 24 are passed into reactor 28. The only source of hydrocarbon liquids injected into reactor 28 will be those produced in reactor 24. Hydrocarbon liquids from any other source are normally not added to reactor 28.

In second stage liquefaction reactor 28, the effluent from the first stage liquefaction reactor 24 is subjected to further liquefaction at a temperature greater than the temperature in reactor 24, normally at a temperature between about 790° F. and about 900° F., preferably between about 820° F. and about 860° F. The pressure in the reactor will normally be maintained between about 300 psig and about 500 psig, preferably between about 1500 psig and about 2500 psig. The solids residence time within the second stage reactor 28 will normally range between about 20 minutes and about 120 minutes and will preferably be between about 40 minutes and about 90 minutes. In general, sufficient hydrogen will be in the feed to the second stage reactor to provide from about 4.5 to about 16 weight percent hydrogen based upon the moisture and ash-free solids fed to the first liquefaction reactor. The hydrogen sulfide present in the feed to the second stage reactor will normally be between about 3 percent and 10 percent by volume of the hydrogen present.

The reactions taking place in the liquefaction zone in the second stage reactor 28 are similar to those that occur in first stage liquefaction reactor 24. The unconverted feed solids and high molecular weight constituents are broken down or cracked and hydrogenated to form lower molecular weight gases and liquids. Molecular hydrogen in the gas phase gives up hydrogen atoms that react with organic radicals formed when the unconverted feed solids and high molecular weight constituents are cracked, thereby preventing their recombination and producing gases and lower molecular weight liquids. Apparently, the hydrogen sulfide serves to facilitate the transfer of hydrogen atoms from the molecular hydrogen to the liberated organic radicals. It is postulated that the hydrogen sulfide gives up hydrogen free radicals to the organic free radicals thereby stabilizing them and at the same time forming hydrogen sulfide free radicals (HS.) which react with the molecular hydrogen in the gas phase to reform hydrogen sulfide and produce additional hydrogen free radicals. Normally, between about 1 weight percent and about 4 weight percent hydrogen, based upon the moisture and ash free solids fed to the first liquefaction reactor 24, is consumed during passage of the reactants through second stage liquefaction reactor 28. Some hydrogen sulfide is also consumed in the reactor.

In conventional coal liquefaction operations, coal is normally slurried with a hydrogen-donor solvent and then contacted with hydrogen in a liquefaction zone operated above about 800° F. A portion of the liquid product produced in the liquefaction zone is then subjected to catalytic hydrogenation in a hydrogenation zone external to the liquefaction zone to regenerate the hydrogen-donor solvent which is then recycled to the process. The external hydrogenation of the coal liquids produced in the liquefaction zone and the recycle of the resultant hydrogen-donor solvent adds appreciably to the cost of the overall liquefaction process. It has been found that liquid yields approaching those obtained in conventional hydrogen-donor liquefaction processes can be obtained without the use of either a vapor phase or liquid phase hydrogen-donor solvent by subjecting certain types of coal or similar solid carbonaceous feed material to liquefaction in a plurality of liquefaction zones arranged in series and operated such that the temperature in each zone increases from the first to the final zone in the series. Normally, the total of the residence times in all except the final zone of the series is greater than the residence time in the final zone. No hydrocarbon liquids are added to the first zone in the series and the only hydrocarbon liquids present in that zone are those generated in situ. Any hydrocarbon liquids present in each succeeding zone in the series are liquids produced in the preceding zones that are passed into that zone. This process of staged temperature liquefaction is as effective in obtaining the conversion of bituminous and other high rank coals into liquids as is a single stage liquefaction process in which the coal is slurried with a hydrogen-donor solvent prior to being subjected to liquefaction conditions. The process, however, is not nearly as effective in obtaining high conversions of subbituminous and other low rank coals into liquids. It has now been found that the liquid yields from this process utilizing a subbituminous and other low rank coals can be substantially increased by carrying out the process in the presence of added hydrogen sulfide gas. It has also been found that the addition of hydrogen sulfide gas will increase liquid yield in a single stage liquefaction process carried out in the absence of an added hydrocarbon solvent.

The process of the invention is based in part upon the discovery that liquid yields from the liquefaction of coal and similar carbonaceous solids in the absence of an added hydrocarbon solvent can be substantially increased by carrying out the liquefaction in the presence of added hydrogen sulfide. "Added hydrogen sulfide" as used herein refers not only to hydrogen sulfide introduced directly into the liquefaction zone but also includes hydrogen sulfide introduced indirectly into the liquefaction zone. "Hydrogen sulfide introduced indirectly into the liquefaction zone" as used herein refers to hydrogen sulfide generated in the liquefaction zone from the reaction of molecular hydrogen with sulfur or a sulfur-containing compound which is introduced into the liquefaction zone and is not a naturally occurring part of the solid carbonaceous feed material. The increase in liquid yield during the liquefaction or chemical conversion of the feed material into lower molecular weight liquids will occur if the liquefaction is carried out in a single liquefaction zone or in multiple liquefaction zones arranged in series and operated such that the temperature increases from the first to the final zone in the series. It is theorized that the hydrogen sulfide causes the increase in liquid yield by facilitating the transfer of hydrogen from the gas phase to the organic fragments or radicals produced during liquefaction. It is believed that the hydrogen sulfide donates hydrogen free radicals to the organic radicals thereby stabilizing them and also forming hydrogen sulfide free radicals (HS.) which react with hydrogen in the gas phase to reform hydrogen sulfide and produce additional hydrogen free radicals. The increased rate of hydrogen transfer from the gas phase to the organic radicals results in more efficient stabilization of the radicals thereby minimizing their recombination and producing higher yields of low molecular weight liquids. Some hydrogen sulfide free radicals will normally react with coal fragments and thus a small amount of hydrogen sulfide will be consumed in the process.

Referring again to the drawing, the effluent from the second stage liquefaction reactor 28 is withdrawn from the top of the reactor through line 30 and passed to separator 32. Here the reactor effluent is separated, preferably at substantially liquefaction pressure, into an overhead vapor stream that is withdrawn through line 34 and a liquid stream recovered through line 36. The overhead vapor stream is passed to downstream units where the ammonia, hydrogen, hydrogen sulfide and carbon dioxide are separated from the low molecular weight gaseous hydrocarbons, which are recovered as valuable byproducts. The hydrogen recovered from the vapor stream is recycled to the process through line 22 for reuse in the liquefaction reactors. The hydrogen sulfide recovered from the vapor stream is recycled via line 17 for reuse in the process. Some of the light hydrocarbons, such as methane and ethane, may be steam reformed to produce hydrogen that can also be recycled through line 22 or used elsewhere in the process.

The liquid stream removed from separator 32 through line 36 will normally contain low molecular weight liquids, high molecular weight liquids, mineral matter and unconverted feed solids. This stream is passed through line 36 into atmospheric distillation column 38 where the separation of low molecular weight liquids from the high molecular weight liquids boiling above about 1000° F. and solids is begun. In the atmospheric distillation column, the feed is fractionated and an overhead fraction composed primarily of gases and naphtha constituents boiling up to about 400° F. is withdrawn through line 40, cooled and passed to distillate drum 42 where the gases are taken off overhead through line 44. This gas stream may be employed as fuel gas for generation of process heat, steam reformed to produce hydrogen that may be recycled to the process where needed, or used for other purposes. Liquids are withdrawn from distillate drum 42 through line 46 and a portion of the liquids may be returned as reflux through line 48 to the upper portion of the distillation column. The remaining naphtha is recovered as product. An intermediate liquid fraction boiling below about 500° F. is withdrawn as product through line 50 and a heavier intermediate fraction composed primarily of constituents boiling below about 700° F. is withdrawn as product through line 52. The bottoms from the distillation column, composed primarily of constituents boiling in excess of 700° F. is withdrawn through line 54, heated to a temperature between about 600° F. and 775° F., and introduced into vacuum distillation column 56.

In the vacuum distillation column, the feed is distilled under reduced pressure to permit the recovery of an overhead fraction that is withdrawn through line 58, cooled and passed to distillate drum 60. Gases are removed from the distillate drum via line 62 and may either be used as fuel, passed to a steam reformer to produce hydrogen for recycling to the process where needed, or used for other purposes. Light liquids are withdrawn from the distillate drum through line 64 and recovered as product. A heavier, intermediate fraction, composed primarily of constituents boiling below about 850° F., may be withdrawn from the vacuum distillation tower through line 66 and a still heavier side stream may be withdrawn through line 68. The bottoms from the vacuum distillation column, which consist primarily of high molecular weight liquids boiling above 1000° F., mineral matter and unconverted feed solids, are withdrawn through line 70 and may be used as a fuel; passed to downstream units to undergo coking, pyrolysis, gasification, partial oxidation or some similar conversion process; or utilized for some other purpose.

In the embodiment of the invention described above and depicted in the drawing, the coal or similar carbonaceous feed material is subjected to staged temperature liquefaction in two consecutive liquefaction reactors each of which is maintained at a relatively constant temperature. It will be understood that the process of the invention is not limited to this method of increasing temperature. For example, the feed material can be subjected to linearly increasing temperatures for a specified period of time before it is subjected to a constant higher temperature for a predetermined period of time which is normally shorter than the time period over which the linear increase in the temperature took place.

The nature and objects of the invention are further illustrated by the results of laboratory tests. The first series of tests illustrates that liquid yields obtained from liquefying coal in the absence of an added hydrocarbon solvent in a single liquefaction zone can be increased by adding hydrogen sulfide to the zone. The second series of tests illustrates that the liquid yields obtained from staged temperature liquefaction of coal in the absence of an added hydrocarbon solvent can be substantially increased by carrying out the process in the presence of added hydrogen sulfide and that such yields approach those obtainable in single stage liquefaction carried out in the presence of an added hydrogen-donor solvent.

In the first series of tests, stainless steel tubing bombs having a volume between 35 and 37 milliliters were charged with three grams of either Illinois #6 bituminous coal or Wyodak subbituminous coal that was ground and screened to −100 mesh on the U.S. Sieve Series Scale. No hydrocarbon solvent was added to the bombs. Sufficient hydrogen was injected into the bombs to produce a hydrogen partial pressure of 1000 psig at 75° F. The bombs were agitated at 120 cycles per minute for a predetermined period of time in a fluidized sand bath heated to a temperature sufficient to provide the desired reaction temperature. After agitation, the bombs were cooled to room temperature and a final pressure was recorded. Gases were bled off overhead of the bombs, measured by glass bomb water displacement and analyzed by gas chromatography. A slurry consisting of high molecular weight carbonaceous particles and mineral matter suspended in liquid hydrocarbons was recovered from each bomb. Each slurry was washed by mixing it for 5 minutes with 10 times its weight in cyclohexane. The mixture was then centrifuged for a period of 15 minutes at a speed of 2000 rpm. The upper layer, which was rich in cyclohexane, was decanted and the remaining bottom layer was remixed with cyclohexane and washed again as described above. This washing procedure was performed a total of 5 times. The amount of solid residue from each bomb that did not dissolve in cyclohexane was measured. The amount of liquids produced in each bomb was then determined by subtracting the sum of the amount of gas and solids produced from the sum of 100 and the amount of hydrogen consumed. The resultant number represents the amount of both hydrocarbon liquids and water that was produced. The water make was not measured directly but was calculated from pressure readings taken during each run. From the data, it is reasonable to assume that about 5 weight percent water was produced in each run with Illinois #6 coal and about 8 weight percent water was produced in each run with Wyodak coal. For comparison purposes, runs were also made with the addition of hydrogen sulfide gas. In these runs gases from the bombs were collected in aluminum bags and analyzed by gas chromatography. The liquid yield was determined by subtracting the sum of the amount of gas and solids produced from the sum of 100 and the amount of hydrogen and hydrogen sulfide consumed. A sufficient amount of hydrogen sulfide was injected into each tubing bomb to produce a hydrogen sulfide partial pressure of 100 psig at 75° F. The amount of hydrogen used in these runs was reduced so that the hydrogen partial pressure was lowered from 1000 to 900 psig at 75° F. In this manner the total pressure in each bomb was kept constant at 1000 psig so that the runs could be directly compared to those in which hydrogen sulfide was not utilized. The results of these tests are set forth in Table I below.

TABLE I

EFFECT OF $H_2S$ ON LIQUID YIELD IN SINGLE STAGE LIQUEFACTION

| Run Number | 1 | 2 | 3 | 4 | 5 | 6 |
|---|---|---|---|---|---|---|
| Coal Type | Wyodak | Wyodak | Wyodak | Wyodak | Ill. #6 | Ill. #6 |
| Temperature, (°F.) | 840 | 840 | 840 | 840 | 840 | 840 |
| Residence Time, (Minutes) | 40 | 40 | 60 | 60 | 40 | 40 |
| $H_2$ Charge, (psig/75° F.) | 1000 | 900 | 1000 | 900 | 1000 | 900 |
| $H_2S$ Charge, (psig/75° F.) | — | 100 | — | 100 | — | 100 |
| Yields, Wt. % Dry Coal | | | | | | |
| Gas | 12.4 | 14.3 | 13.2 | 12.9 | 7.8 | 8.1 |
| Liquids | 23* | 26** | 26* | 29** | 25* | 28** |
| Bottoms | 66 | 61 | 63 | 60 | 69 | 65 |
| $H_2$ Consumption, Wt. % Dry Coal | 1.3 | 1.3 | 1.6 | 1.6 | 1.7 | 1.9 |
| $H_2S$ Consumption, Wt. % Dry Coal | — | 0.6 | — | 0.8 | — | 0.7 |

*Includes water and is equal to [(100 + $H_2$ consumption) − (bottoms + gas)]
**Includes water and is equal to [(100 + $H_2$ and $H_2S$ consumption) − (bottoms + gas)]

The first four runs in Table I indicate that the presence of hydrogen sulfide increases liquid yield about 3 weight percent when Wyodak subbituminous coal is subjected to single stage liquefaction in the absence of an added hydrocarbon solvent. It would appear by comparing runs 3 and 4 with runs 1 and 2 that an increase in residence time increases the overall amount of liquids produced but does not affect the incremental increase caused by the presence of the hydrogen sulfide. Runs 5 and 6 illustrate that added hydrogen sulfide increases the liquid yield from the liquefaction of Illinois #6 coal, a bituminous coal, in the absence of an added hydrocarbon solvent about 3 weight percent.

In the second series of tests, Wyodak subbituminous coal was treated in the manner described in the preceding series of tests except that after each tubing bomb was subjected to a low temperature heating step for a particular residence time, it was removed from the sand bath and placed in a second sand bath maintained at a temperature sufficient to increase the temperature in the tubing bomb to a predetermined value which was maintained for a predetermined length of time to simulate a staged temperature liquefaction in the absence of externally added hydrocarbon solvent. The tubing bomb was then cooled and the same procedure as in the first series of tests was followed to analyze the products produced during liquefaction. The results of these tests are set forth below in Table II. For comparison purposes, data is also included in the Table for a single stage run made with the addition of a hydrogen-donor solvent to the tubing bomb. The solvent used contained a donatable hydrogen concentration of about 1.5 weight percent and a sufficient amount of the solvent was injected into the bomb to provide a solvent-to-coal weight ratio of about 1.6. The results of these tests are set forth below in Table II.

TABLE II

EFFECTS OF $H_2S$ ON LIQUID YIELD IN STAGED TEMPERATURE LIQUEFACTION

| Run Number | 7 | 8 | 9 | 10 | 11 | 12 | 13 | 14 | 15 |
|---|---|---|---|---|---|---|---|---|---|
| Coal Type | Ill. #6 | Ill. #6 | Ill. #6 | Wyodak | Wyodak | Wyodak | Wyodak | Wyodak | Wyodak |
| First Stage Temp., (°F.) | — | 700 | — | 700 | 700 | 750 | 750 | 700 | — |
| First Stage Residence Time, (Minutes) | — | 150 | — | 150 | 150 | 40 | 40 | 40 | 13 |
| Second Stage Temp., (°F.) | 840 | 840 | 840 | 840 | 840 | 840 | 840 | 840 | 840 |
| Second Stage Residence Time, (Minutes) | 60 | 60 | 40 | 60 | 60 | 40 | 40 | 40 | 40 |
| $H_2$ Charge, (psig/75° F.) | 1000 | 1000 | 650 | 1000 | 900 | 1000 | 900 | 900 | 650 |
| $H_2S$ Charge, (psig/75° F.) | — | — | — | — | 100 | — | 100 | 100 | — |
| Liquid Solvent Charged* (Solvent-to-coal wt. ratio) | — | — | 1.6 | — | — | — | — | — | 1.6 |
| Yields, Wt. % Dry Coal | | | | | | | | | |
| Gas | 8.7 | 8.8 | 10.0 | 12.4 | 12.6 | 11.4 | 10.9 | 11.0 | 13.2 |
| Liquids | 24** | 37** | 39** | 28** | 35*** | 25** | 28*** | 29*** | 37** |
| Bottoms | 68 | 56 | 53 | 62 | 57 | 65 | 63 | 62 | 53 |
| $H_2$ Consumption, Wt % Dry Coal | 1.3 | 2.5 | 2.5 | 1.9 | 2.0 | 1.3 | 1.6 | 1.4 | 2.6 |
| $H_2S$ Consumption, Wt. % Dry Coal | — | — | — | — | 2.1 | — | N/A | N/A | — |

*Donatable hydrogen concentration of 1.5 wt. %
**Includes water and is equal to [(100 + $H_2$ consumption) − (bottoms + gas)]
***Includes water and is equal to [(100 + $H_2$ and $H_2S$ consumption) − (bottoms + gas)]

Run 7 in Table II indicates that 24 weight percent liquids based on dry coal are obtained when subjecting Illinois #6 coal to single stage liquefaction in the absence of an added hydrogen-donor solvent. Run 9 indicates that this liquid yield is substantially less than that obtainable by carrying out the liquefaction in the presence of an added hydrogen-donor solvent. By comparing run 8 with runs 7 and 9, it can be seen that staged temperature liquefaction of Illinois #6 coal in the absence of an added hydrogen-donor solvent significantly increases liquid yield over that obtainable from single stage liquefaction in the absence of an added solvent, and that this increased yield of 37 weight percent approaches the liquid yield of 39 weight percent obtainable by single stage liquefaction in the presence of an added donor solvent. By comparing run 3 in Table I with runs 10 and 15 in Table II, it can be seen that similar results are not obtained when liquefying Wyodak subbituminous coal. Run 3 in Table I indicates that 26 weight percent liquids based on dry coal are produced when subjecting Wyodak coal to single stage liquefaction in the absence of an added donor solvent. Run 10 in Table II illustrates that this liquid yield is increased only slightly to 28 weight percent when the liquefaction is carried out in a staged temperature operation. Run 15 indicates that this increased yield is substantially lower than the 37 weight percent obtained by subjecting the Wyodak coal to single stage liquefaction in the presence of an added hydrogen-donor solvent.

Runs 10, 11 and 15 in Table II show that the addition of hydrogen sulfide during the staged temperature liquefaction of Wyodak coal in the absence of an added hydrogen-donor solvent will substantially increase the liquid yield to a value which approaches that obtainable from single stage liquefaction carried out in the presence of an added donor solvent. As can be seen from runs 10 and 11, the addition of hydrogen sulfide to a staged temperature liquefaction operation carried out in the absence of an added solvent results in the liquid yield being increased from 28 weight percent to 35 weight percent—a yield only 2 weight percent lower than that obtained from single stage liquefaction in the presence of an added donor solvent (run 15). By comparing runs 12 and 13 with runs 10 and 11, it can be seen that a lower residence time in the first stage of a staged temperature operation will reduce the beneficial effect that added hydrogen sulfide has on both overall and incremental liquid yields. A comparison of run 14 with run 13 tends to indicate that a change of temperature in the 700° F. to 750° F. range in the first stage has little effect on liquid yields.

It will be apparent from the preceding discussion that the invention provides an improved process for converting coal into a liquid product. The process results in an increase in liquid yields obtainable from both single stage and staged temperature liquefaction carried out in the absence of an externally added hydrocarbon solvent.

We claim:

1. A process for liquefying coal or similar carbonaceous solids by converting said solids into lower molecular weight liquid hydrocarbons which comprises contacting said carbonaceous solids with molecular hydrogen under liquefaction conditions in a liquefaction zone in the absence of externally added hydrocarbon liquids and in the presence of added hydrogen sulfide, wherein the pressure in said liquefaction zone is maintained between about 300 psig and 5000 psig.

2. A process as defined in claim 1 wherein the temperature in said liquefaction zone is between about 790° F. and about 860° F.

3. A process as defined in claim 1 wherein the pressure in said liquefaction zone is between about 1500 psig and about 2500 psig.

4. A process as defined in claim 1 wherein a sufficient amount of hydrogen sulfide is introduced into said liquefaction zone to yield a hydrogen sulfide concentration in said zone of between about 3 volume percent and about 10 volume percent based on the amount of hydrogen present in said zone.

5. A process as defined by claim 1 wherein said carbonaceous solids are contacted with molecular hydrogen in the absence of an externally added vapor phase hydrocarbon solvent.

6. A process as defined by claim 1 wherein the temperature in said liquefaction zone is between about 750° F. and about 900° F. and wherein a sufficient amount of hydrogen sulfide is introduced into said liquefaction zone to yield a hydrogen sulfide concentration in said zone of between about 1 volume percent and about 30 volume percent based on the amount of hydrogen present in said zone.

7. A process as defined by claim 1 wherein the solids residence time in said liquefaction zone is between about 20 minutes and about 200 minutes.

8. A process for liquefying coal or similar carbonaceous solids by converting said solids into lower molecular weight liquid hydrocarbons which comprises:

(a) contacting said carbonaceous solids with molecular hydrogen in the absence of externally added hydrocarbon liquids and in the presence of added hydrogen sulfide under liquefaction conditions during sequential residence in two or more liquefaction zones arranged in series and operated such that (i) the temperature in each zone increases from the first to the final zone of the series, (ii) the total of the solids residence times in all except the final zone of the series is sufficient to produce an increase in liquid yield over that which would be obtainable by a single stage liquefaction carried out under the conditions in said final zone and (iii) the pressure in each zone is between about 300 psig and about 5000 psig, wherein said carbonaceous solids are partially converted into lower molecular weight liquid hydrocarbons in each of said liquefaction zones and the only hydrocarbon liquids added to each liquefaction zone subsequent to said first liquefaction zone are the liquids in the effluent from the preceding liquefaction zone; and (b) recovering liquid hydrocarbonaceous product from the effluent of said final liquefaction zone.

9. A process as defined in claim 8 wherein the total of the solids residence times in all except the final zone of the series is greater than about 40 minutes.

10. A process as defined in claim 8 wherein said first liquefaction zone is operated at a temperature between about 680° F. and about 750° F.

11. A process as defined in claim 8 wherein said carbonaceous solids comprise subbituminous coal.

12. A process as defined in claim 8 wherein the temperature in said first liquefaction zone is in the range between about 690° F. and about 720° F. and the solids residence time in said first liquefaction zone is between about 120 minutes and about 170 minutes.

13. A process as defined in claim 8 wherein the temperature in said final liquefaction zone is in the range between about 820° F. and about 860° F. and the solids residence time in said final liquefaction zone is between about 40 minutes and about 90 minutes.

14. A process as defined in claim 8 wherein two liquefaction zones are employed in step (a).

15. A process as defined in claim 8 wherein sufficient hydrogen sulfide is added to said first liquefaction zone to provide a concentration of hydrogen sulfide in all of said zones between about 1 volume percent and about 30 volume percent based on the amount of hydrogen gas present in said zones.

16. A process as defined by claim 8 wherein the temperature in said first liquefaction zone is between about 680° F. and 750° F., the temperature in said final liquefaction zone is greater than about 790° F., and wherein sufficient hydrogen sulfide is added to said first liquefaction zone to provide a concentration of hydrogen sulfide in all of said zones between about 1 volume percent and about 30 volume percent based on the amount of hydrogen gas present in said zones.

17. A process as defined by claim 16 wherein the solids residence time in said first liquefaction zone is greater than about 40 minutes and the solids residence time in said second liquefaction zone is between about 20 minutes and about 120 minutes.

18. A process as defined by claim 8 wherein the pressure in all of said liquefaction zones is between about 1500 psig and about 2500 psig.

19. A process for liquefying coal by converting said coal into lower molecular weight liquid hydrocarbons which comprises:

(a) contacting said coal with molecular hydrogen under liquefaction conditions at a temperature of at least about 650° F. and at a pressure between about 300 psig and about 5000 psig in the absence of externally added hydrocarbon liquids and in the presence of added hydrogen sulfide in a first liquefaction zone to at least partially convert said coal into lower molecular weight liquid hydrocarbons thereby producing a liquefaction effluent;

(b) subjecting said liquefaction effluent from said first liquefaction zone to liquefaction conditions in the presence of molecular hydrogen and hydrogen sulfide in a second liquefaction zone maintained at a pressure between about 300 psig and about 5000 psig and at a temperature above about 790° F. and greater than the temperature in said first liquefaction zone thereby further converting said coal into lower molecular weight liquid hydrocarbons, wherein the only hydrocarbon liquids added to said second liquefaction zone are those liquids in said liquefaction effluent from said first liquefaction zone and wherein a sufficient amount of hydrogen sulfide is added to said first liquefaction zone to provide a hydrogen sulfide concentration in said first and said second zones of between about 1 and about 30 volume percent based on the amount of hydrogen present in each zone; and (c) recovering liquid hydrocarbonaceous products from the effluent of said second liquefaction zone.

20. A process as defined in claim 19 wherein said coal comprises subbituminous coal.

21. A process as defined in claim 19 wherein said solids residence time in said first liquefaction zone is greater than about 40 minutes and said solids residence time in said second liquefaction zone is between about 20 and about 120 minutes.

22. A process as defined in claim 19 wherein the temperature in said first liquefaction zone is between about 680° F. and about 750° F. and the temperature in said second liquefaction zone is between about 790° F. and about 900° F.

23. A process as defined in claim 19 wherein a sufficient amount of hydrogen sulfide is added to said first liquefaction zone to provide a hydrogen sulfide concentration in said zone of between about 3 and about 10 volume percent and a hydrogen sulfide concentration in said second liquefaction zone of between about 3 volume percent and about 10 volume percent, said concentrations based on the amount of hydrogen present in each zone.

24. A process as defined by claim 19 wherein the solids residence time in said first liquefaction zone is greater than the solids residence time in said second liquefaction zone.

* * * * *